US007007344B2

(12) United States Patent
Lee

(10) Patent No.: US 7,007,344 B2
(45) Date of Patent: Mar. 7, 2006

(54) SAFETY UNIT OF HINGE FOR FOLDING LADDER

(76) Inventor: Chan Bok Lee, 238-29, Sajik 1-Dong, Heungdeok-gu, Cheongju-city, Chungcheongbuk-do (KR)

( * ) Notice: Subject to any disclaimer, the term of this patent is extended or adjusted under 35 U.S.C. 154(b) by 0 days.

(21) Appl. No.: 10/800,126

(22) Filed: Mar. 12, 2004

(65) Prior Publication Data

US 2005/0166364 A1 Aug. 4, 2005

(30) Foreign Application Priority Data

Jan. 29, 2004 (KR) ..... 20-2004-0002118

(51) Int. Cl.
*E05D 15/50* (2006.01)

(52) U.S. Cl. ..... 16/231; 16/377; 403/62; 403/68; 403/23; 182/163; 182/22; 182/24

(58) Field of Classification Search ..... 16/231, 16/250, 251, 268, 355, 377, 387, 388; 182/163, 182/22–26, 156; 403/62, 96, 68, 93, 23, 403/12

See application file for complete search history.

(56) References Cited

U.S. PATENT DOCUMENTS 1,626,844 A * 5/1927 Kuhn ..... 160/229.1
2,557,716 A * 6/1951 Allee ..... 16/250
3,319,697 A * 5/1967 Krohn ..... 160/229.1
3,941,180 A * 3/1976 Thill ..... 160/229.1
4,040,142 A * 8/1977 Ippolito ..... 16/251
4,770,559 A 9/1988 Yoo
4,893,666 A * 1/1990 Hormann ..... 160/229.1
5,220,708 A * 6/1993 Lucas et al. ..... 16/225
5,669,431 A * 9/1997 Druzynski et al. ..... 160/229.1
5,842,508 A * 12/1998 Krupke et al. ..... 160/235
6,029,409 A * 2/2000 Wilson ..... 52/202
6,298,605 B1 * 10/2001 Delefosse et al. ..... 49/383
6,343,406 B1 * 2/2002 Yeh ..... 16/328
6,688,797 B1 * 2/2004 Park et al. ..... 403/93
2004/0216954 A1 11/2004 Lee

* cited by examiner

*Primary Examiner*—Brian E. Glessner
*Assistant Examiner*—Mark Williams
(74) *Attorney, Agent, or Firm*—McCarter & English, LLP

(57) ABSTRACT

Disclosed herein is a safety unit of a hinge for a folding ladder to prevent a user's finger from being caught in the hinge when the hinge rotates. The hinge includes a first joint unit, a second joint unit, and a locking unit, and the safety unit is provided between a first stop shoulder of the first joint unit and a second stop shoulder of the second joint unit. The safety unit includes a mount part and an insert part. The mount part is provided in the first joint unit to be positioned under the first stop shoulder, and an inside portion of the mount part is rounded to surround a part of the first joint unit. The insert part extends from an upper end of the mount part, and is rounded to have the same curvature as the inside portion of the mount part. When the second joint unit rotates relative to the first joint unit, the insert part is inserted into the second stop shoulder, Further, an insert blade is inwardly projected from horizontal center lines of inside portions of both the mount part and the insert part, and is circumferentially inserted into an outer circumferential surface of the first joint unit.

1 Claim, 4 Drawing Sheets

PRIOR ART

PRIOR ART

SAFETY UNIT OF HINGE FOR FOLDING LADDER

BACKGROUND OF THE INVENTION

1. Field of the Invention

The present invention relates generally to hinges for folding ladders, and more particularly, to a safety unit of a hinge for a folding ladder, which prevents a user's finger from being undesirably caught in the hinge when the hinge rotates.

2. Description of the Related Art

Generally, a ladder comprises a rod- or tube-shaped frame which is made of metal. Since the ladder is large in volume, the ladder is manufactured to be foldable. FIGS. 1 and 2 show conventional hinges for folding ladders. As shown in FIG. 1, the hinge 10 includes a first joint unit 12 having a pair of discs, a second joint unit 14 having one disc, a locking unit 18, and a guide disc (not shown). The first and second joint units 12 and 14 are coupled to each other by a central shaft 16, and pivot on the central shaft 16 while rotating relative to each other. The guide disc is provided between the discs of the first joint unit 12 to be operated in cooperation with the second joint unit 14. Thus, according to a position of the guide disc, the locking unit 18 provided at a predetermined portion of the first joint unit 12 engage with one of notches 20 provided along a peripheral edge of the disc of the second joint unit 14, so that the first and second joint units 12 and 14 are locked at a desired angular position.

However, when a strong impact acts on the hinge 10 in a state where the hinge 10 is angled at 180°, the hinge 10 may be undesirably folded or a load may be concentrated on the central shaft 16, thus causing deformation of the central shaft 16 and thereby leading to a malfunction of the hinge 10.

In order to solve this problem, as shown in FIG. 2, the first and second joint units 12 and 14 have first and second stop shoulders 22 and 24, respectively, thus preventing the hinge 10 from further rotating when the first and second joint units 12 and 14 are angled at 180°.

However, such a hinge 10 has a problem in that a user's finger may be caught between the first and second stop shoulders 22 and 24, when the second joint unit 14 rotates relative to the first joint unit 12 and the first and second stop shoulders 22 and 24 come into contact with each other.

SUMMARY OF THE INVENTION

Accordingly, the present invention has been made keeping in mind the above problems occurring in the prior art, and an object of the present invention is to provide a safety unit for a hinge of a folding ladder, which is provided between a first stop shoulder of a first joint unit and a second stop shoulder of a second joint unit, thus preventing a user from being injured when the first and second stop shoulders come into contact with each other.

In order to accomplish the above object, the present invention provides a safety unit of a hinge for a folding ladder. In this case, the hinge includes a first joint unit, a second joint unit, a guide disc, and a locking unit. The first joint unit has at a predetermined position thereof a first stop shoulder. The second joint unit is coupled to the first joint unit by a central shaft so that the first and second joint units pivot on the central shaft while rotating relative to each other. A second stop shoulder is provided at a predetermined position of the second joint unit to be opposite to the first stop shoulder. The guide disc is provided in the first joint unit to be operated in cooperation with the second joint unit. The locking unit is provided at a predetermined position of the first joint unit, and engages with one of notches provided along a peripheral edge of the second joint unit so that the first and second joint units are locked at a desired angular position. The safety unit is provided between the first and second stop shoulders, and includes a mount part, an insert part, and an insert blade. The mount part is fastened to a predetermined portion of the first joint unit to be positioned under the first stop shoulder. An inside portion of the mount part is rounded to surround a part of the first joint unit. The insert part integrally extends from an upper end of the mount part, and is rounded to have a same curvature as the inside portion of the mount part. The insert part is inserted into the second stop shoulder when the second joint unit rotates relative to the first joint unit. The insert blade is inwardly projected from horizontal center lines of inside portions of both the mount part and the insert part, and is circumferentially inserted into an outer circumferential surface of the first joint unit.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
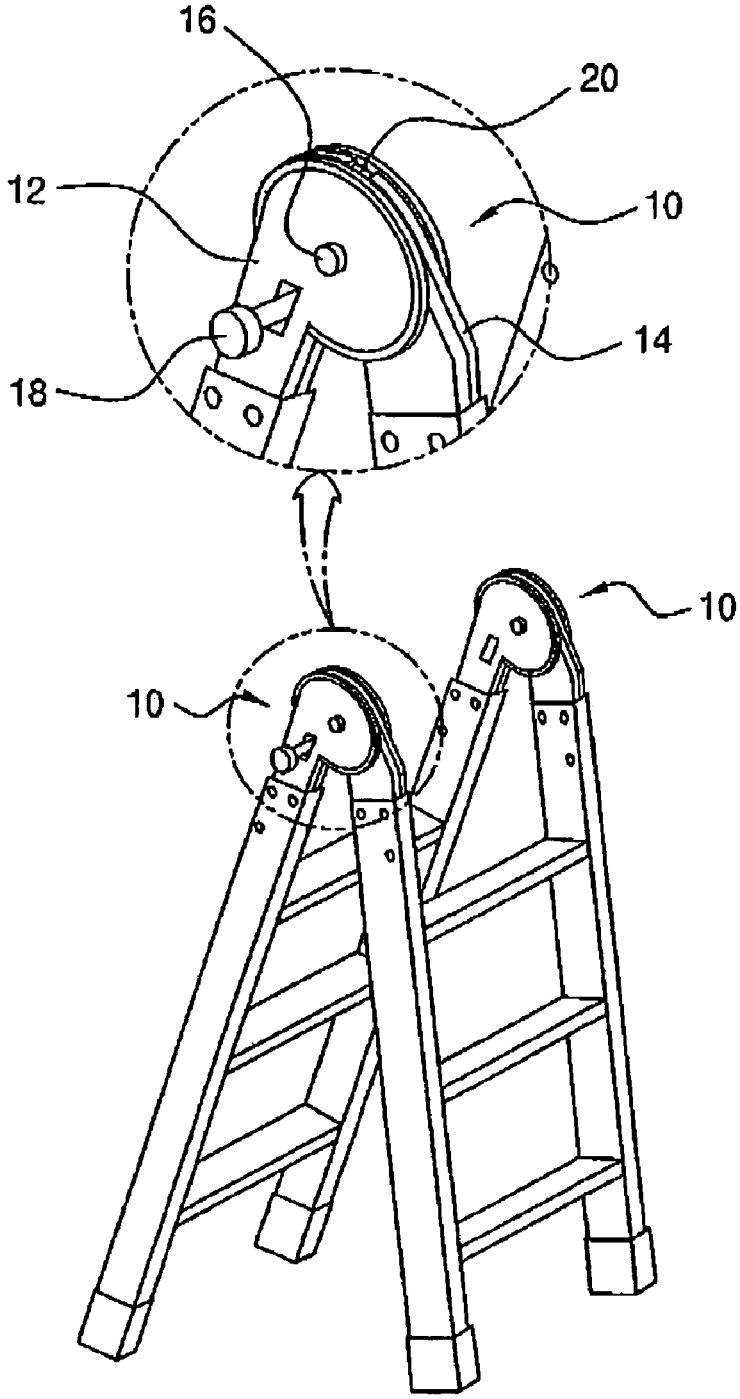
FIGS. 1 and 2 are views to show conventional hinges for folding ladders.
Figure 2:
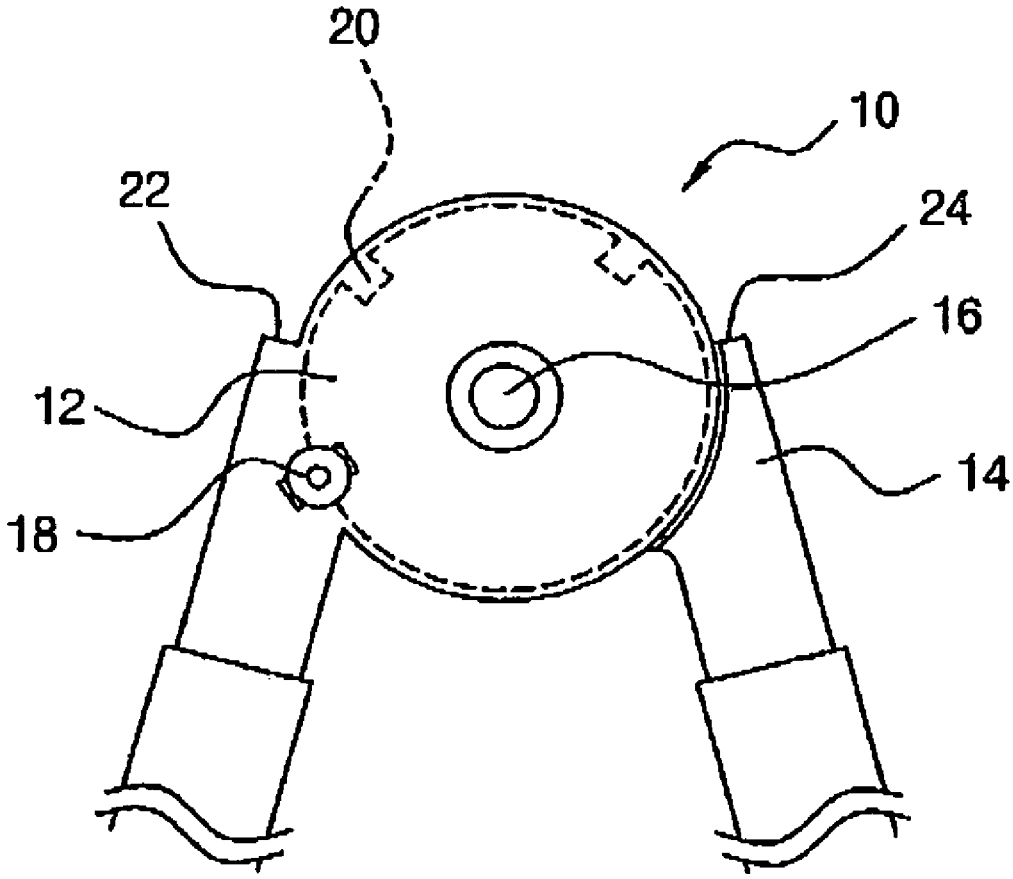

Hereinafter, embodiments of the present invention will be described in detail with reference to the attached drawings.

Reference now should be made to the drawings, in which the same reference numerals are used throughout the different drawings to designate the same or similar components.

Figure 3:
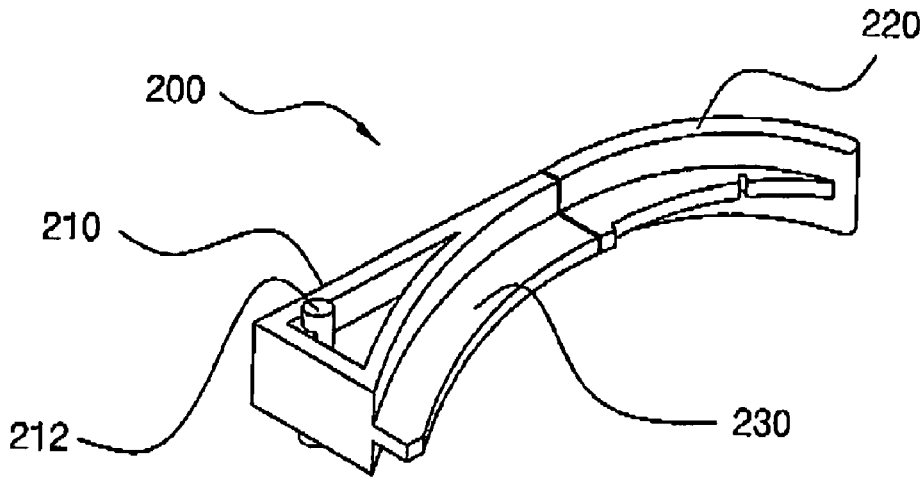
FIG. 3 is a perspective view of a safety unit, according to an embodiment of the present invention.
Figure 4:
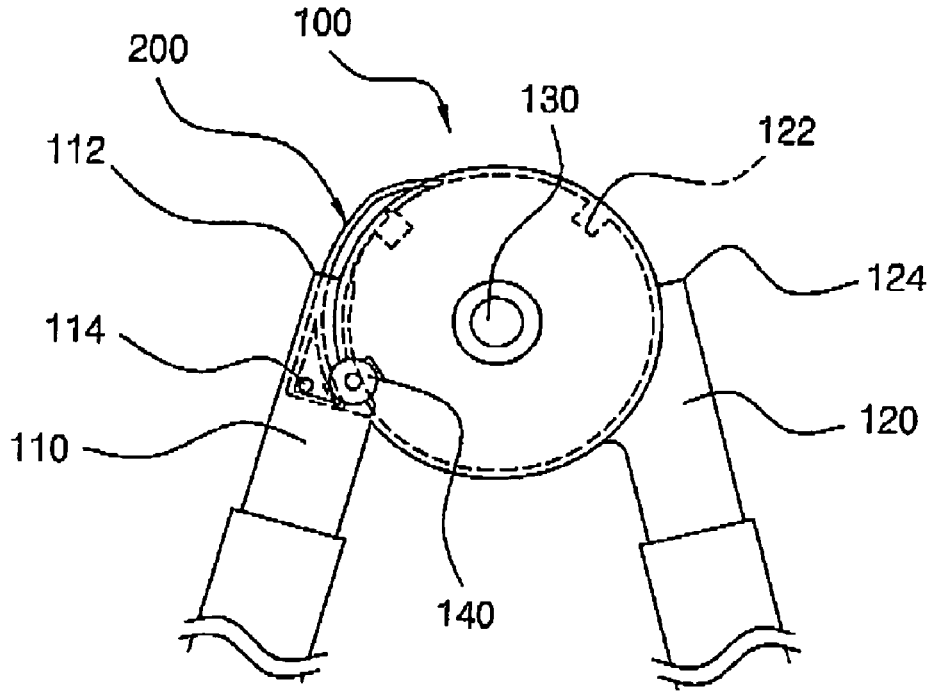
FIG. 4 is a side view of a hinge for a folding ladder having the safety unit of FIG. 3.

FIG. 3 is a perspective view of a safety unit, according to an embodiment of the present invention, and FIG. 4 is a side view of a hinge for a folding ladder having the safety unit of FIG. 3.

Referring to FIGS. 3 and 4, a hinge 100 according to this invention includes a first joint unit 110 having a pair of discs, and a second joint unit 120 having a disc. The first and second joint units 110 and 120 are coupled to each other by a central shaft 130, and pivot on the central shaft 130 while rotating relative to each other. A guide disc is provided between the discs of the first joint unit 110 to be operated in cooperation with the second joint unit 120. Further, a locking unit 140 is provided at a predetermined portion of the first joint unit 110, and engages with one of notches 122 provided along a peripheral edge of the disc of the second joint unit 120, so that the first and second joint units 110 and 120 are locked at a desired angular position. Further, according to the present invention, the hinge 100 includes a safety unit 200.

Further, a first stop shoulder 112 is provided at a predetermined position of the first joint unit 110, and a second stop shoulder 124 is provided at a predetermined position of the second joint unit 120 to be opposite to the first stop shoulder 112. Thus, when the first and second joint units 110 and 120 are angled at 180°, the first and second stop shoulders 112 and 124 come into contact with each other. Further, a mount hole 114 is provided at a predetermined portion of the first joint unit 110 to be placed under the first stop shoulder 112.

The safety unit 200 is disposed between the first and second stop shoulders 112 and 124. As shown in FIG. 3, the safety unit 200 includes a mount part 210 and an insert part 220. The mount part 210 is fastened to the first joint unit 110 to be positioned under the first stop shoulder 112. A mount rod 212 is provided at a predetermined position of the mount part 210 to be projected outward, so that the mount rod 212 is fitted into the mount hole 114 of the first joint unit 110. In this case, an inside portion of the mount part 210 is rounded to surround a part of outer circumferential surfaces of the discs of the first joint unit 110.

Further, the insert part 220 has a shape of a plate, and integrally extends from an upper end of the mount part 210 to be curved at the same curvature as the inside portion of the mount part 210. An insert blade 230 is inwardly projected from horizontal center lines of inside portions of both the mount part 210 and the insert part 220. The insert blade 230 is circumferentially inserted between the outer circumferential surfaces of the discs of the first joint unit 110 to allow the safety unit 200 to be in more close contact with the first joint unit 110.

The use of the hinge 100 constructed as described above will be described in brief in the following.

Figure 5:
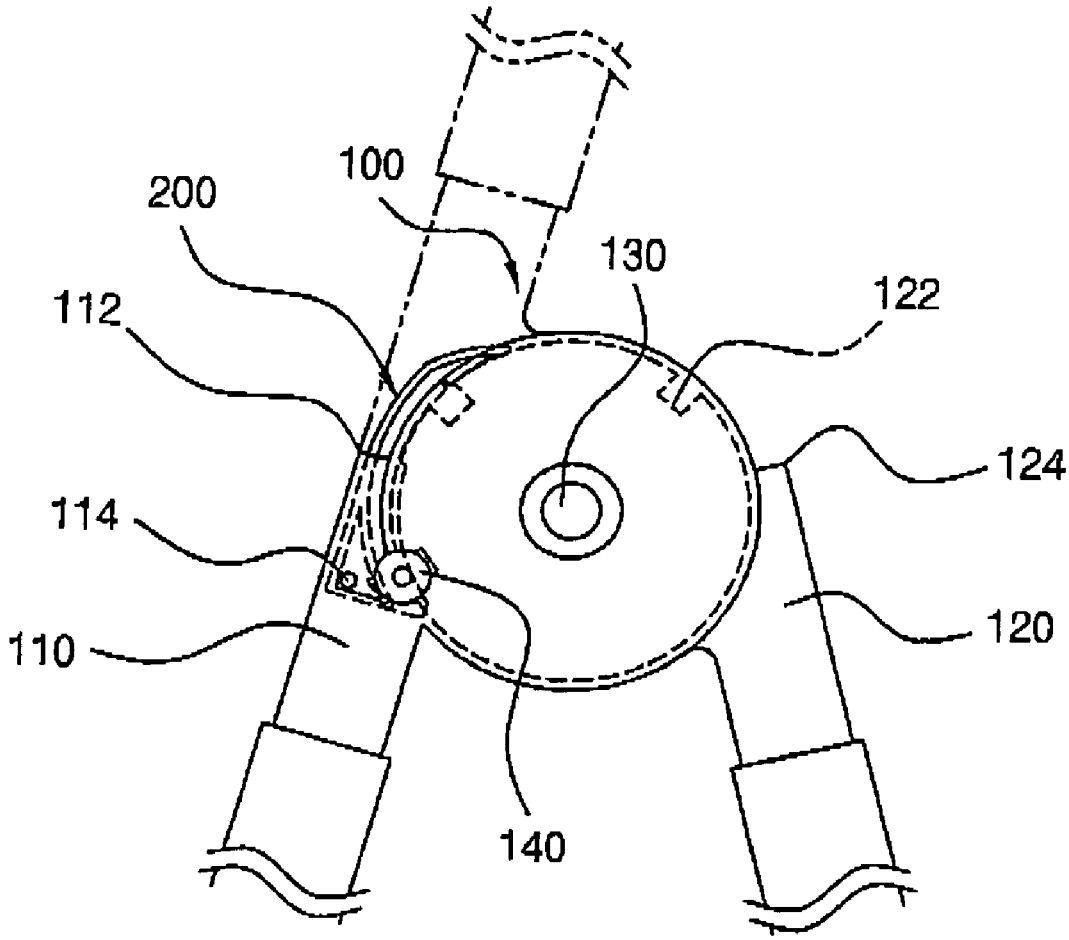
FIG. 5 is a view to show an operation of the hinge of FIG. 4.

FIG. 5 is a view to show the operation of the hinge 100 for the folding ladder, according to the present invention.

Referring to FIG. 5, when a user desires to keep the folding ladder in a place, the first and second joint units 110 and 120 are closed so that inside portions of the first and second joint units 110 and 120 come into contact with each other. In this case, the volume of the folding ladder is minimized, thus it is easier to keep the folding ladder in a place. Meanwhile, when the user desires to use the folding ladder, the locking unit 140 is pressed to be unlatched. When the locking unit 140 is unlatched, the first and second joint units 110 and 120 pivot on the central axis 130 to adjust the angle between the first and second joint units 110 and 120, as desired. In a detailed description, the plurality of notches 122 are provided along the peripheral edge of the disc of the second joint unit 120. Thus, while the second joint unit 120 rotates relative to the first joint unit 110, the locking unit 140 of the first joint unit 110 engage with one of the notches 122, so that the folding ladder is locked at a desired angular position. Meanwhile, when the first and second joint units 110 and 120 are angled at 180°, the first stop shoulder 112 of the first joint unit 110 comes into contact with the second stop shoulder 124 of the second joint unit 120. At this time, the insert part 220 of the safety unit 200 is inserted into the second stop shoulder 124, thus preventing an object from being caught between the first and second stop shoulders 112 and 124.

As described above, the present invention provides a safety unit of a hinge for a folding ladder, which closes a space between a first stop shoulder of a first joint unit and a second stop shoulder of a second joint unit when the hinge rotates, thus preventing a user's finger from being caught between the first and second stop shoulders.

Although the preferred embodiments of the present invention have been disclosed for illustrative purposes, those skilled in the art will appreciate that various modifications, additions and substitutions are possible, without departing from the scope and spirit of the invention as disclosed in the

What is claimed is:

1. A safety unit of a hinge for a folding ladder, the hinge comprising: a first joint unit having at a predetermined position thereof a first stop shoulder; a second joint unit coupled to the first joint unit by a central shaft so that the first and second joint units pivot on the central shaft while rotating relative to each other, with a second stop shoulder being provided at a predetermined position of the second joint unit to be opposite to the first stop shoulder; a guide disc provided in the first joint unit to be operated in cooperation with the second joint unit; and a locking unit provided at a predetermined position of the first joint unit, the locking unit engaging with one of notches provided along a peripheral edge of the second joint unit so that the first and second joint units are locked at a desired angular position, the safety unit being provided between the first and second stop shoulders, and comprising:

a mount part fastened to a predetermined portion of the first joint unit to be positioned under the first stop shoulder, with an inside portion of the mount part being rounded to surround a part of the first joint unit;

an insert part integrally extending from an upper end of the mount part and rounded to have a same curvature as the inside portion of the mount part, the insert part being inserted into the second stop shoulder when the second joint unit rotates relative to the first joint unit;

an insert blade inwardly projected from horizontal center lines of inside portions of both the mount part and the insert part, the insert blade being circumferentially inserted into an outer circumferential surface of the first joint unit;

a mount hole provided at a predetermined portion of the first joint unit to be disposed under the first stop shoulder; and a mount rod provided at a predetermined position of the mount part to be fitted into the mount hole.

* * * * *